United States Patent [19]

Taub

[11] Patent Number: 5,050,748

[45] Date of Patent: Sep. 24, 1991

[54] GRAVITY-FEED COOLER RACK

[76] Inventor: Ronald Taub, 1154 Sheridan Rd., Highland Park, Ill. 60035

[21] Appl. No.: 575,327

[22] Filed: Aug. 30, 1990

[51] Int. Cl.[5] ..... A47F 5/00

[52] U.S. Cl. ..... 211/59.2; 211/126; 211/153; 312/42

[58] Field of Search ..... 211/59.2, 126, 133, 211/184, 153; 312/72, 45, 36

[56] References Cited

U.S. PATENT DOCUMENTS

| | | | |
|---|---|---|---|
| 4,478,337 | 10/1984 | Flum | 211/59.2 |
| 4,593,823 | 6/1986 | Fershko et al. | 211/133 X |
| 4,598,828 | 7/1986 | Young et al. | 211/59.2 |
| 4,785,943 | 11/1988 | Deffner et al. | 211/59.2 |
| 4,785,945 | 11/1988 | Rowse et al. | 211/59.2 |
| 4,801,025 | 1/1989 | Flum et al. | 211/59.2 X |
| 4,923,070 | 5/1990 | Jackle et al. | 211/59.2 |
| 4,958,739 | 9/1990 | Spamer | 211/59.2 X |

*Primary Examiner*—Robert W. Gibson, Jr.
*Attorney, Agent, or Firm*—Michael G. Berkman

[57] ABSTRACT

A rack for holding containers in a cooler for ultimate sequential removal therefrom. The rack consists of a series of elongate, imperforate trays disposed side-by-side as a columnar array. Fabricated of a molded plastics composition, the trays are integrally formed on the outer faces of sidewalls thereof, with tenon-like keys and cooperating mortise-like recesses for effecting interlocking keying engagement between laterally abutting, adjacent trays of the rack. The rack, as selected, may combine as many trays as are needed, including trays having columns of varying lateral width. In one embodiment of the invention, each tray is formed, at an end thereof with a severable, modular section whereby an optional shortening of the column in the rack may be conveniently and simply effected.

7 Claims, 2 Drawing Sheets

GRAVITY-FEED COOLER RACK

BACKGROUND AND FIELD OF THE INVENTION

The present invention relates to a rack for supporting cans, bottles, or other containers in a refrigerated cabinet or chest. More particularly, the present invention is directed to a rack taking the form of a columnar array of trays detachably connected laterally and adapted to be supported in an angular mode to facilitate gravity feed of the containers, in turn, to a retrieval zone.

The use, generally, of racks in coolers as conveyances for the containers of the products being cooled is a technique well-established in the art. The racks themselves have taken various physical forms and have been fabricated of different types of materials. For the most part, the racks used have been of particular predetermined dimensions and have been unalterable to accommodate either different spatial dimensions, the site in which the rack is used, or to accommodate different sizes of containers to be cooled.

Others of the racks have interfered with the circulation of cooled fluid media and have, accordingly, been ineffective in optimizing heat transfer and resultant cooling. Others of prior art racks have been fixedly secured in the cooler itself and have thus rendered it difficult to effect cleaning to maintain the desired level of sanitation and cleanliness.

While extensive time and effort have been expended to provide cooling racks for refrigerated cabinets, no completely satisfactory structure has heretofore been made available. Accordingly, it is a principal aim of the present invention to obviate many of the shortcomings of prior art cooling racks and to provide a simple structure of high mechanical strength which permits, at the same time, the ready circulation of cooling fluid which will accommodate containers of various sizes, and which is, itself, adjustable in its overall length.

SUMMARY OF THE INVENTION

In accordance with the present invention, there is provided a rack for holding containers in a cooler for sequential removal therefrom. The rack is comprised of a series of elongate, imperforate trays exposed side-by-side as a columnar array on which the cooled articles travel. Fabricated of a high, mechanical strength molded plastics composition, the trays are integrally formed on outer faces with cooperating mechanical components by means of which individual trays of the rack are physically attached to one another to provide a unitary, stabilized structure. In preferred embodiments of the rack, the trays may be of different lateral widths so as to accommodate articles of different dimensions. Additional physical features of the racks are the use of low friction rails upon which the articles bear during their travel, and the formation of spaced, numerous openings in the rack itself to facilitate the distribution and circulation of a cooling medium.

In a preferred embodiment of the rack of the invention, each lineal tray includes an end section which may be readily severed and removed so as to provide a rack of adjustable overall length. The co-lineal trays of the rack may be combined in any preferred number to form multiple, interconnected columns so as to fit conveniently in any allocated floor space.

Other and further features, advantages and objects of the present invention will be evident from a reading of the following description considered in conjunction with the accompanying drawings.

DETAILED DESCRIPTION OF THE ILLUSTRATED EMBODIMENTS

Figure 1:
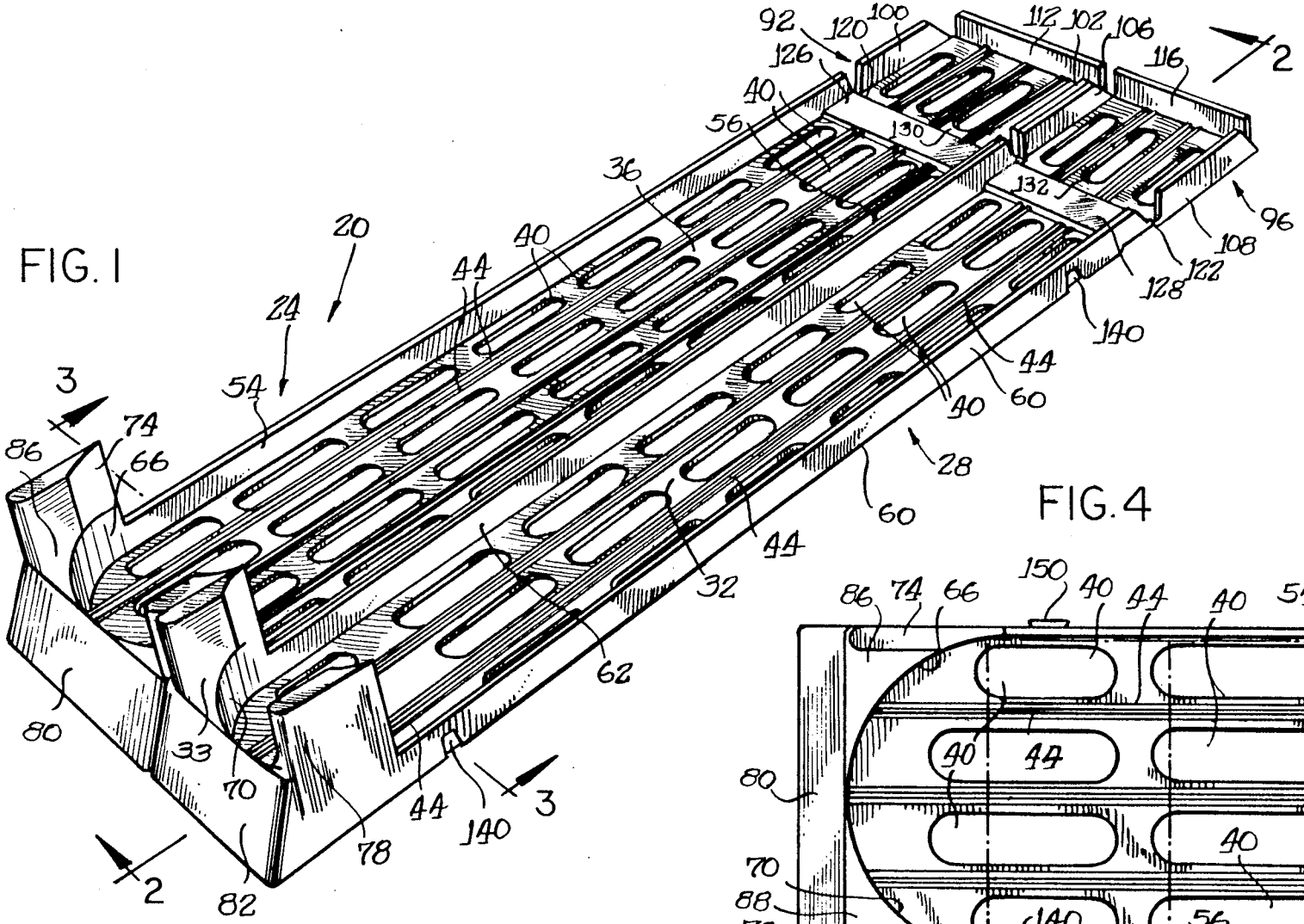
FIG. 1 is a perspective view of a rack according to the invention, embodying the features thereof.

The aims and objects of the invention are achieved by providing a rack of high-strength molded plastics composition, and which includes a plurality of elongate trays of open or lattice-type structures and which are attachable laterally along their lineal expanses to provide a unitary structure. In accordance with the practice of the invention, it is contemplated that the array of trays which constitute the rack itself includes tray elements which differ in their lateral widths for accommodating containers of different widths.

Additionally, each of the trays itself is formed at an end with a frangible section which may be easily and quickly detached so as to provide a length adjustment of the overall assembly should this be desired.

Other important features of the tray elements themselves, are the inclusion of lineally coextensive upstanding guidewalls for restraining the containers laterally and floor-supported rails upon which the containers ride as they traverse the length of the tray itself. Any desired number of trays may be quickly and easily joined to one another along their lateral walls to provide a unitary structure of selectable widths. The tray structures themselves are of a lattice-type configuration to facilitate the unimpaired circulation of cooling fluid.

Referring now to the drawings and, more particularly, to FIGS. 3-6, for purposes of illustrative disclosure and not in any limiting sense, a preferred embodiment of the invention is shown as a rack 20 composed of a plurality of trays 24 and 28 of molded plastics composition. In the specific embodiment of the rack 20 shown, the trays 24 and 28 are of the same lineal length, but are of different lateral widths. While the illustrated rack shows only two laterally joined trays, any preferred number of trays may be assembled to provide a unitary structure of any desired overall width.

Each tray has a lattice-like floor 32 and 36 formed with openings or cut-out sections 40 to facilitate the circulation of cooling fluid generated in the cooler itself (not shown). Integrally formed with the floors 32 and 36 and extending lineally the full length of the tray itself, are elongated raised bars or rails 44 on which the containers 50 to be cooled are supported and travel (FIG. 2).

Each tray 24 and 28 is integrally formed with upstanding sidewalls 54 and 56, and 60 and 62 which serve as guides and retainers for the containers 50 which are stored upon and which travel along the tray rails 44.

At its lower or delivery end, each tray 24 and 28 of the illustrated embodiment of the rack 20 is formed with a reinforced, arcuate, upstanding endwall 66 and 70 and upstanding piers 74 and 78. The lower extremity of the assemblies is integrally formed with angled flanges 80 and 82 and surmounting ridge sections 86 and 88 which further stabilize and strengthen the assembly.

Figures 2, 3, 5, 6, 7:
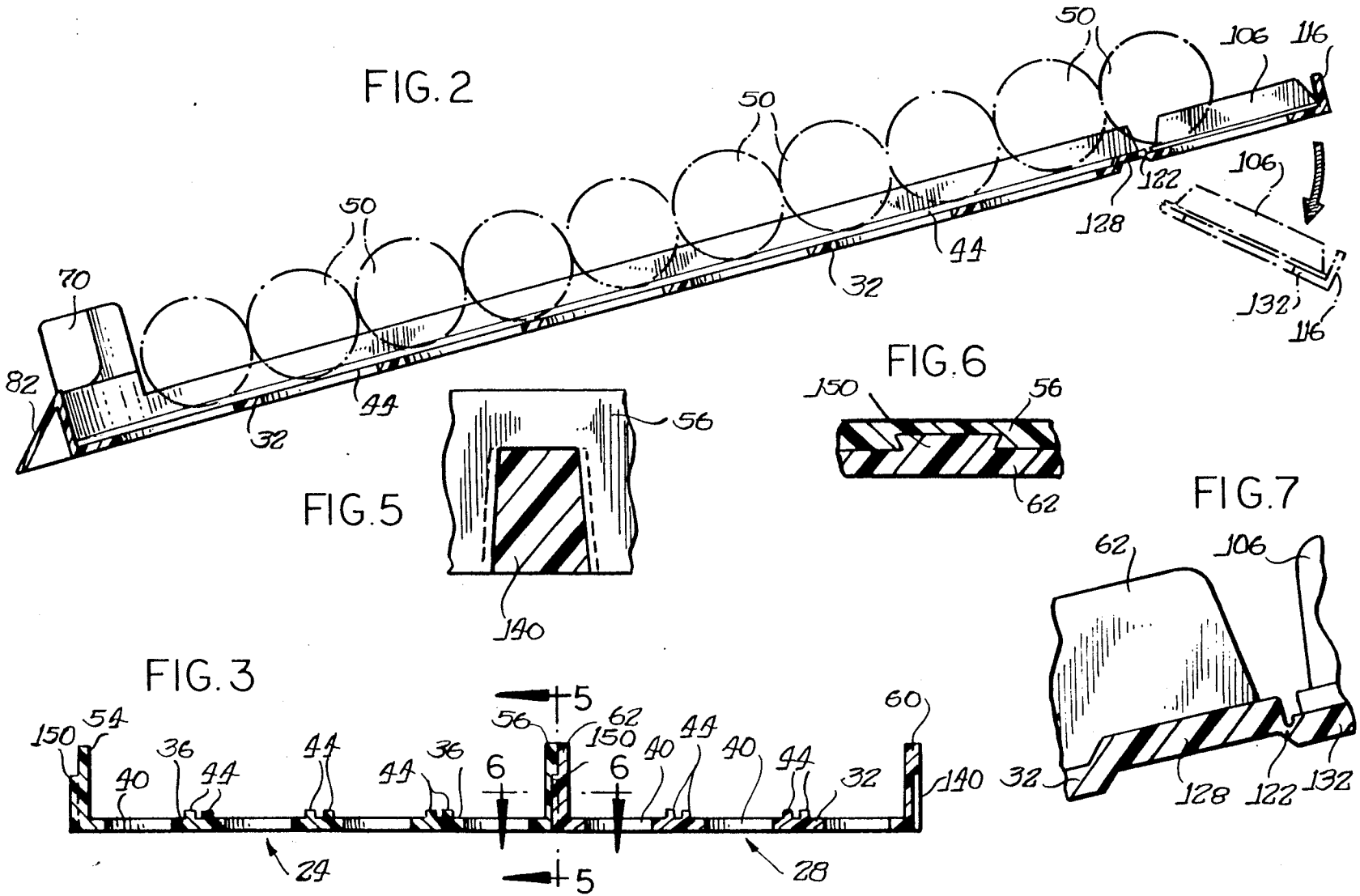
FIG. 2 is a cross-sectional view taken substantially on the lines 2—2 of FIG. 1 and depicting, schematically, a column of containers stored as a lineal array in the rack.
FIG. 3 is a cross-sectional view taken substantially on the lines 3—3 of FIG. 1 and showing two laterally-joined trays of the rack.
FIG. 5 is an enlarged, cross-sectional view taken substantially on the lines 5—5 of FIG. 3 and showing a tapered keying slot or socket formed in a sidewall of the tray of the rack.
FIG. 6 is an enlarged, cross-sectional; view taken substantially on the lines 6—6 of FIG. 3 and showing a flared tenon and mortise providing a dove-tailed joinder or interlocking of laterally abutting trays.
FIG. 7 is an enlarged, fragmentary view showing the frangible juncture connecting a separable end section of a tray to facilitate an optional shortening of the tray.

As shown in FIGS. 1, 2 and 7, each tray 24 and 28 of the rack includes at its upper end an optionally removable sector 92 and 96 having sidewalls 100 and 102 and 106, 108 and endwalls 112 and 116. Each sector 902 and 96 is connected to the tray proper, 24 and 28, along a fracture line 120 and 122 extending along end plates 126 and 128 along which the floor 130 and 132 of the sectors 92 and 96 abut the respective trays 24 and 28.

In the embodiment of the invention illustrated, should it be desirable to shorten the overall length of the rack, this may be readily accomplished by forcibly bending the extension sectors 92 and 96 downwardly along a fracture line defined by the juncture 120 and 122 to break the connection between the extending sectors 92 and 96 and the corresponding trays 24 and 28.

Figure 4:
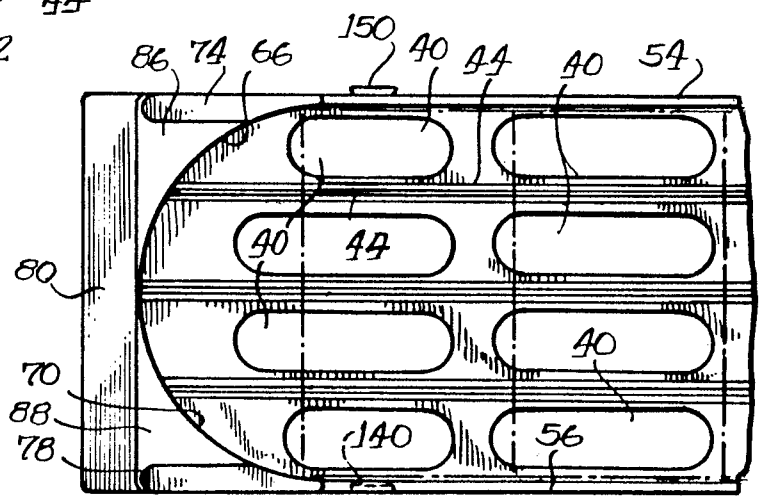
FIG. 4 is an enlarged, fragmentary view of the wider of two trays in the assembly of FIG. 1.

The manner in which two or more trays may be joined laterally is described with reference to FIGS. 1 and 3–6. As shown in FIGS. 1 and 3 and 4, one sidewall 56 and 60, the opposite side 54 and 62 of each tray 24 and 28 is formed with two or more dovetail-shaped tenons 150 at lineal positions corresponding with or in registry with intercoupling engagement within the keying slots 140 of juxtaposed adjacent, coextensive trays, to provide a unitary composite assembly constituting the rack of the invention. It is believed that the method of combining a plurality of tray elements of selectable widths to provide a composite rack assembly having appropriate width and length dimensions will be readily evident from the foregoing detailed description. The low friction characteristics of the plastics materials used enhances the gravity feed of the cooled containers arranged in the rack, as indicated schematically in FIG. 2.

While particular embodiments of the invention have been shown and described in detail, it will be obvious to those skilled in the art that changes and modifications of the present invention, in its various aspects, may be made without departing from the invention itself in its broader aspects. Some of the changes and modifications will be merely matters of routine engineering and design, and others will be apparent only after study. As such, the scope of the invention should not be limited by the particular embodiments illustrated and specific construction described herein but should be defined by the appended claims and equivalents thereof. Accordingly, the aim of the appended claims is to cover all such changes and modifications as fall within the true spirit and scope of the invention.

What is claimed is:

1. A rack for holding containers for sequential removal from a cooler;

said rack comprising an elongate tray including lattice-like floor means for supporting containers as a stacked, lineal, columnar array thereon to travel therealong;

lineally extending, spaced, parallel, upstanding guide wall means at each of lateral boundaries of said tray for retaining and for guiding movement of containers traversing said floor means of said tray;

segmental module means integrally formed at an end of said tray and joined to said floor means of said tray for extending the length of said tray, said module means including sidewalls aligned with said guide wall means of said tray as extensions thereof, frangible connector means joining said module means to said tray and delineating a fracture zone facilitating separation of said module means from said tray;

said connector means being integrally formed with said tray at opposed guide wall means thereof at outer lateral faces of said guide wall means for intercoupling one said tray with a second tray as a lineally coextensive, laterally-abutting and transversely-joined columnar pair of trays;

elongate rail means located between said guide wall means and extending substantially coextensively with a parallel to said guide wall means for supporting said containers on said floor means during travel along said tray;

said floor means being formed with rows of lineally and laterally spaced openings along a length expanse of said tray for facilitating access of cooling fluid to containers supported on and traversing said tray;

base wall means joined to and defining means constituting a stop abutment for and an end limit of travel of containers contained in said rack.

2. The structure as set forth in claim 1 and further comprising elongate rail means located between said guide walls and extending substantially coextensively with and parallel to said guide wall means for supporting said containers on said floor means during travel along said floor means of said tray.

3. A rack for holding containers for sequential removal from a cooler;

said rack comprising an elongate tray including lattice-like floor means for supporting containers as a stacked, lineal, columnar array thereon to travel therealong;

lineally extending, spaced, parallel, upstanding guide wall means at each of lateral boundaries of said tray for retaining and for guiding movement of containers traversing said floor means of said tray;

elongate rail means located between said guide wall means and extending substantially coextensively with and parallel to said guide wall means for supporting said containers on said floor means during travel along said tray;

said floor means being formed with rows of lineally and laterally spaced openings along a length expanse of said tray for facilitating access of cooling fluid to containers supported on and traversing said tray;

base wall means joined to and defining means constituting a stop abutment for and an end limit of travel of containers contained in said rack;

connector means integrally formed with said tray at opposed guide wall means thereof at outer lateral faces of said guide wall means for intercoupling one said tray with a second tray as a lineally-coextensive, laterally-abutting and transversely-joined columnar pair of trays;

said connector means comprising tenon means for coupling within cooperating mortise-like recess means of said tray, said tenon means being formed at lineally spaced positions along a length of said tray and extending outwardly from a first of said guide walls at an outer face thereof; and wherein a second of said guide walls is formed with recess means therein defining a mortise-like keying slot for accepting said tenon means in coupling engagement therewithin;

said recess means being formed at correspondingly lineally-spaced positions along said guide walls for aligning with said tenon means and for establishing registry between said connector means for adjacently-positioned trays to form a rack including a stabilized side-by-side array of interlocked trays.

4. A rack for holding containers for sequential removal from a cooler;

said rack comprising an elongate tray including lattice-like floor means for supporting containers as a stacked, lineal, columnar array thereon to travel therealong;

lineally extending, spaced, parallel, upstanding guide wall means at each of lateral boundaries of said tray for retaining and for guiding movement of containers traversing said floor means of said tray;

elongate rail means located between said guide wall means and extending substantially coextensively with and parallel to said guide wall means for supporting said containers on said floor means during travel along said tray;

said floor means being formed with rows of lineally and laterally spaced openings along a length expanse of said tray for facilitating access of cooling fluid to containers supported on and traversing said tray;

base wall means joined to and defining means constituting a stop abutment for and an end limit of travel of containers contained in said rack;

connector means integrally formed with said tray at opposed guide wall means thereof at outer lateral faces of said guide wall means for intercoupling one said tray with a second tray as a lineally-coextensive, laterally-abutting and transversely-joined columnar pair of trays;

said connector means comprising tenon means for coupling within cooperating mortise-like recess means of said tray, said tenon means being formed at lineally spaced positions along a length of said tray and extending outwardly from a first of said guide walls at an outer face thereof; and wherein a second of said guide walls is formed with recess means therein defining a mortise-like keying slot for accepting said tenon means in coupling engagement therewithin;

said recess means being formed at correspondingly lineally-spaced positions along said guide walls for aligning with said tenon means and for establishing registry between said connector means of adjacently-positioned trays to form a rack including a stabilized side-by-side array of interlocked trays;

and further comprising an additional tray coextensive with said columnar pair of trays and connected thereto laterally thereof to establish a columnar array of separate but interconnected trays.

5. The structure as set forth in claim 3 wherein said rack comprises a plurality of lineally coextensive trays arranged in a side-to-side array.

6. The structure as set forth in claim 5 wherein said plurality of trays includes trays differing in their width dimensions.

7. A rack for holding containers for sequential removal from a cooler;

said rack comprising an elongate tray including lattice-like floor means for supporting containers as a stacked, lineal, columnar array thereon to travel therealong;

lineally extending, spaced, parallel, upstanding guide wall means at each of lateral boundaries of said tray for retaining and for guiding movement of containers traversing said floor means of said tray;

segmental module means integrally formed at an end of said tray and joined to said floor means of said tray for extending the length of said tray, said module means including sidewalls aligned with said guide wall means of said tray as extensions thereof, and frangible connector means joining said module means to said tray and delineating a fracture zone facilitating separation of said module means from said tray; elongate rail means located between said guide wall means and extending substantially coextensively with and parallel to said guide wall means for supporting said containers on said floor means during travel along said tray;

said floor means being formed with rows of lineally and laterally spaced openings along a length expanse of said tray for facilitating access of cooling fluid to containers supported on and traversing said tray;

base wall means joined to and defining means constituting a stop abutment for and an end limit of travel of containers contained in said rack; and connector means integrally formed with said tray at opposed guide wall means thereof at outer lateral faces of said guide wall means for intercoupling one said tray with a second tray as a lineally-coextensive, laterally-abutting and transversely-joined columnar pair of trays.

* * * * *